US005269078A

United States Patent [19]

Cochrane

[11] Patent Number: 5,269,078

[45] Date of Patent: Dec. 14, 1993

[54] APPARATUS FOR SUPPLYING SUPPORTING FORCE

[75] Inventor: Charles R. Cochrane, Mammoth Lakes, Calif.

[73] Assignee: Robert G. Carter, Fresno, Calif. ; a part interest

[21] Appl. No.: 733,129

[22] Filed: Jul. 19, 1991

Related U.S. Application Data

[63] Continuation of Ser. No. 387,486, Jul. 31, 1989, abandoned.

[51] Int. Cl.[5] ..... A43B 7/22; A43B 7/14

[52] U.S. Cl. ..... 36/93; 36/88; 36/50.1; 36/170

[58] Field of Search ..... 36/88, 89, 58.5, 58.6, 36/91, 92, 93, 50; 128/80 H, 166, 611

[56] References Cited

U.S. PATENT DOCUMENTS

| | | | |
|---|---|---|---|
| 960,545 | 6/1910 | Harris | 36/50 |
| 1,328,333 | 1/1920 | Mann | 36/50 |
| 1,545,623 | 7/1925 | Westfall | 36/89 |
| 1,663,221 | 3/1928 | Scroggins | 36/89 |
| 1,708,156 | 4/1929 | Scroggins | 36/89 |
| 4,236,328 | 12/1980 | Friedlander | 128/166 |
| 4,640,025 | 2/1987 | DeRenzo | 128/166 |
| 4,649,939 | 3/1987 | Curtis | 36/89 |
| 4,811,500 | 3/1989 | Maccano | 36/91 |

FOREIGN PATENT DOCUMENTS

| | | | |
|---|---|---|---|
| 333488 | 8/1930 | United Kingdom | 128/611 |

*Primary Examiner*—Steven N. Meyers
*Attorney, Agent, or Firm*—Worrel & Worrel

[57] ABSTRACT

An apparatus for supplying supporting force in a boot or the like having predetermined first and second sides, the apparatus having a force applying system including a plurality of first securing points mounted in substantially fixed relation on the boot on the first side, a second securing point mounted in substantially fixed relation on the boot on the second side and a force applying member linking through the system the first securing points and the second securing point and adapted to draw the first and second securing points substantially toward each other to apply a selected force capturing the foot in the boot.

8 Claims, 3 Drawing Sheets

APPARATUS FOR SUPPLYING SUPPORTING FORCE

This is a continuation of application Ser. No. 07/387,486, filed on Jul. 31, 1989, now abandoned.

BACKGROUND OF THE INVENTION

1. Field of the Invention:

The present invention relates to an apparatus for supplying supporting force and more particularly to such an apparatus which is adapted for use in a boot or the like to apply pressure to the foot and ankle of the person wearing the boot in such a manner as to support the muscles, tendons, ligaments and bones in the optimum position for use while interoperating with the natural physiological structure and functioning of those portions of the foot and ankle to afford the utmost comfort.

2. Description of the Prior Art:

The anatomical complexity of the muscles, tendons, ligaments and bones of the foot and ankle of the human body are such as to permit a complex variety of flexure and muscular exertion. Through such a medium, the human body is capable of performing seemingly an infinite variety of tasks which otherwise would be difficult or impossible.

Many of these tasks require an instinctive or learned sensitivity to the flexure or force required and may involve only the slightest degree of application of, or reaction to, the force necessary to perform the task involved. For example, the basic human act of walking is largely dependent upon a sense of balance gauged by and maintained through the application of force through the toes of the foot.

Notwithstanding the physiological capabilities of the human foot and ankle, there are certain activities in which these capabilities are not compatible with the most effective and comfortable performance thereof. For example, in such activities as skiing, mountain climbing and the like, the severe forces generated, unless controlled, cause flexure in the foot and ankle which interfere with the activity while encouraging injury.

More particularly, in skiing, control of the skis is largely accomplished through the transmission of force by the muscles of the legs to the skis. The infinite variety of flexure possible in the feet and ankles of the human body can interfere with this transmission of force. When these conditions are coupled with the forces developed as a result of the high speeds and forces of gravity involved, there can be a severe inadequacy of control and an enhanced possibility of severe injury.

Similarly, in mountain climbing, hiking and the like, the uneven terrain over which passage is required insures that each step taken is likely to be on other than a flat surface and frequently on a surface which does not afford sure footing. Accordingly, the risk of injury such as sprained or broken ankles and the like is considerable. In all such activities, but additionally in the simple act of walking, the arch of the foot is exposed to strain or collapse.

In activities such as these, it has long been known that it would be desirable to maintain the foot and ankle in a neutral, or central, supported position to enhance the degree of control while minimizing the susceptibility to injury. The most common approach in achieving this objective has been to clamp the foot and ankle in locked position permitting little or no motion. Such prior art devices have met with varying degrees of success. However, all such prior art devices have suffered, to varying degrees, from characteristic failings. Such devices typically do not interoperate with the anatomical structure and functioning of the foot and ankle, but rather are designed simply to clamp the foot and ankle in fixed position. Accordingly, the natural flexure and exertion of force through the muscles, tendons, ligaments and bones of the foot and ankle work against the clamping force causing, to varying degrees, continual pain and discomfort during the entire time such prior art devices are worn. Typically, in order to achieve the maximum desired result, the user operates the device to apply the maximum clamping force. This not only produces the pain and discomfort previously noted, but also can interfere with the proper circulation of blood through the feet and ankles which is both uncomfortable and hazardous.

Therefore, it has long been known that it would be desirable to have an apparatus for supplying supporting force operable to support the muscles, tendons, ligaments and bones of the feet and ankles for the performance of activities such as skiing, mountain climbing, hiking and the like; which interoperates with the natural anatomical flexure and functioning of these muscles, tendons, ligaments and bone in achieving the objective so as to minimize the pain and discomfort associated therewith and to afford the optimum degree of control desired for the specific task to be performed; and which is adaptable to virtually any type of shoe or boot to achieve these objectives.

SUMMARY OF THE INVENTION

Therefore, it is an object of the present invention to provide an improved apparatus for supplying supporting force.

Another object is to provide such an apparatus which is particularly well suited to use as an integral part of boots and the like for applying support to the muscles, tendons, ligaments and bones of the foot and ankle in such a manner as substantially to enhance the capability of the wearer to perform the specific task to be performed.

Another object is to provide such an apparatus which interoperates with the natural flexure, muscular exertion and muscular reaction inherent in the functioning of the foot and ankle of the human body.

Another object is to provide such an apparatus which is particularly well suited to use in skiing and hiking boots to secure the muscles, tendons, ligaments and bones of the foot and ankle in such a manner as to ensure the optimum operation of the feet and ankles during skiing, hiking, mountain climbing or the like without the pain or discomfort associated with prior art devices and in such a manner as to reduce to a minimum the likelihood of injury as a result of strain to the feet and ankles or as a result of a lack of control resulting from any lack of flexural support.

Another object is to provide such an apparatus which is adaptable for use in virtually all boots, shoes or the like to afford the support required for the specific task to be achieved.

Another object is to provide such an apparatus which is of minimal expense to construct and to employ either when retrofitted into existing boots or shoes or when manufactured as an integral part thereof.

Another object is to provide such an apparatus which is capable of a subtlety of adjustment suited to the use of the operator, wherein, the operator is required only to pull a strap in a single direction until the comfort and support desired are achieved without having to have any technical knowledge to achieve the desired result.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
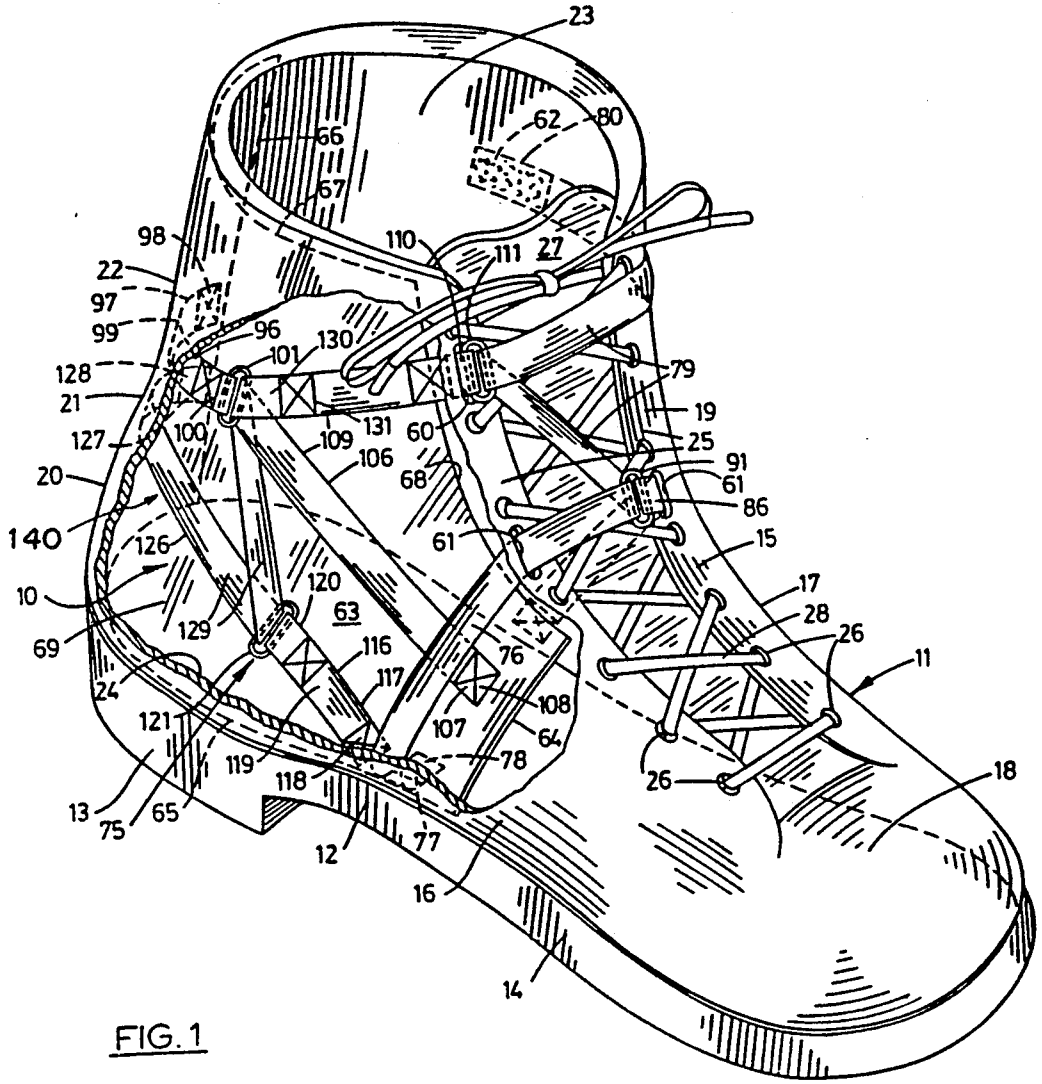
FIG. 1 is a fragmentary perspective view of a boot mounting the apparatus of the present invention in a secured attitude.

Referring more particularly to the drawings, the apparatus of the present invention is generally indicated by the numeral 10 in FIG. 1.

As will be more clearly apparent, the apparatus of the present invention is adapted for use on virtually all types of boots, shoes, or the like. In this respect, it can be employed on virtually all types of ski boots, hiking boots, mountain climbing boots, walking shoes, athletic shoes or other footwear. While the trend over the last twenty years has been entirely toward the use of plastics and other synthetic materials in ski boots, this has resulted primarily from the desire to be able to apply the maximum clamping force to the foot and ankle. Similarly, the same objective over the last twenty years has been a reason for the use of buckles instead of laces in boots employed for skiing. Since the apparatus of the present invention is not dependent for its superior operation upon the use of buckles or the like, it will become apparent that the apparatus can be employed in a boot construction which more nearly resembles that of a conventional walking shoe.

Accordingly, the boot 11 shown in FIG. 1 on which the apparatus 10 of the present invention is mounted is shown as a lace type boot. The boot 11, when equipped with the apparatus of the present invention, can be employed for skiing, mountain climbing, hiking, walking or the like. When used as a ski boot, it has the additional benefit of permitting comfortable walking while going to or from the slopes for skiing, unlike conventional ski boots. It is to be understood, however, that the apparatus of the present invention can be employed in more traditional plastic, buckle or lever type ski boots with equal advantage.

The boot 11 has a sole 12 composed of a heal portion 13 and a forward portion 14. The boot has an upper 15 which may be constructed of leather or a synthetic material. The upper has an outside portion 16 and an opposite inner side portion 17. The upper has a forward front portion 18 joining the forward portion of the sole about its lateral margins. The upper has an upper front portion 19. The upper has a lower back portion 20, a middle back portion 21 and an upper back portion 22, all of which form an integral part of the upper.

The boot has an interior 23 bounded by the sole 12 and an interior surface 24 of the upper 15. The upper has side flaps 25 which individually are pierced by a plurality of eyelets or lace openings 26. The upper mounts a tongue 27 extending beneath the flaps. A lace or shoe string 28 is interlaced through the eyelets in the conventional fashion affording the capability of drawing the side flaps 25 toward each other overlapping the tongue in such a manner as to be comfortable. The shoe string is then tied in a suitable knot, such as a bow.

Figure 5:
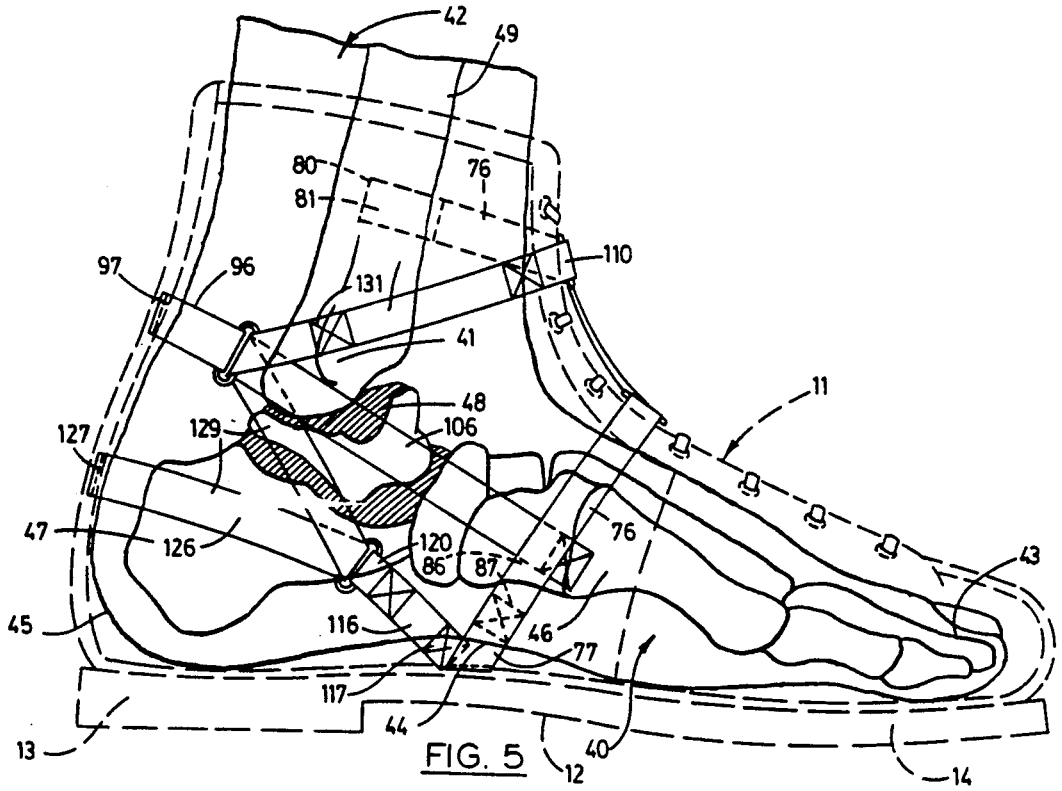
FIG. 5 is a diagrammatic side elevation of the apparatus of the present invention shown in a typical operative relation with respect to the bones of the foot and ankle of a person wearing a boot mounting the apparatus and wherein the boot is shown in phantom lines.

Referring more particularly to FIG. 5, for illustrative convenience, the boot 11 is shown as worn by a person in a typical manner. As shown therein, the foot is indicated at 40, the ankle at 41 and the leg at 42. The toes are indicated at 43 with the foot having an arch 44 and a heal 45. Referring more particularly to the anatomical detail of the foot, ankle and leg, the metatarsal bone is indicated at 46. The calcaneus bone is indicated at 47, the ankle joint at 48 and the tibia bone at 49. The purpose for showing the anatomical detail of the foot, ankle and leg is to show the preferred relative position of the apparatus 10 to these anatomical features thereof.

The portions of the boot 11 heretofore described are conventional. In order to accommodate the apparatus 10, the boot is modified slightly from such conventional construction. Such modification includes the provision of an upper slot or opening 60 formed in the upper front portion 19 of the upper 15 in the side flap 25 on the left as boot in FIG. 1. A pair of central slots or openings 61 are provided in the upper front portion 19 individually in the side flaps 25 thereof substantially in juxta position and in predetermined spaced relation beneath the upper opening 60. A "Velcro" patch 62 is mounted on the inner side portion 17, as shown best in FIG. 3.

The apparatus 10 includes an interior liner or panel 63 best shown in FIG. 1. The panel is mounted on the interior surface 24 of the upper 15 against the outside portion 16. The interior panel has a leading edge 64, a lower edge 65, and a rear edge 66. Similarly, the interior panel has an upper edge 67 and an arcuate edge 68 interconnecting the upper edge and the leading 64. The interior panel is preferably stitched or otherwise secured along its respective edges on the interior surface 24 of the outer side portion 16 to define a pocket 69 between the interior surface 24 and the interior panel 63. The remainder of the apparatus 10 is captured between the interior panel 63 and the interior surface 24 of the out side portion 16. Thus, the portions of the apparatus hereinafter to be described are substantially isolated from the foot 40 of the person wearing the boot 11. If desired, the boot can have an inner liner to separate the panel 63 from the foot in order to provide a smooth interior surface.

The apparatus 10 has a force applying assembly or system generally indicated by the numeral 75 in FIG. 1. The force applying system is largely contained within the pocket 69 so that it is isolated from the foot 40 of the person wearing the boot. The force applying system has a first member or strap 76 having a proximal portion 77 mounted on the sole 12 of the boot at securing point 78. The first strap has a force applying portion which extends through the central opening 61 on the left as viewed in FIG. 1 to the exterior of the boot, this portion of the first strap constituting a force applying portion 79 of the first strap. The force applying portion has a distal portion 80 mounting a "Velcro" patch 81.

The force applying system 75 has a second member or strap 86 having a proximal portion 87 mounted on the interior surface 24 of the inner side portion 17 of the upper 15 adjacent to the sole 12 at a securing point 88. The second strap has a force applying portion 89 which extends outwardly of the boot through the central opening 61 on the right as viewed in FIG. 1. The second strap has a distal portion 90 which is outwardly of the boot and mounts a ring 91.

A third member or strap 96, having a proximal portion 97, is mounted on the interior surface 24 of the middle back portion 21 of the upper 15 at securing point 98. The third strap has a force applying portion 99 with a distal portion 100 mounting a ring 101.

A fourth member or strap 106, having a proximal, portion 107, is mounted on the interior surface 24 of the outer side portion 16 of the upper 15 at securing point 108. The fourth strap has a force applying portion 109 which extends through the ring 101 of the third strap 96 and extends to a distal portion 110 extending through the upper opening 60. The fourth strap has a distal portion 110 mounting a ring 111 which is external of the boot. The distal portion 110 of the fourth strap 106 is, in some instances, referred to herein as an "upper member or strap" for illustrative convenience.

The force applying system 75 has a fifth member or strap 116, having a proximal portion 117, mounted on the interior surface 24 of the out side portion 16 at securing point 118. The fifth strap extends toward the lower back portion 20 of the upper 15 having a force applying portion 119 and a distal portion 120 mounting a ring 121.

A lower strap or sixth member or strap 126, having a proximal portion 127, is mounted on the interior surface 24 of the lower back portion 20 of the upper 15 at securing point 128. The sixth strap has a force applying portion 129 which extends through the ring 121 of the fifth strap 116 and through the ring 101 of the third strap 96 in overlaying relation to the fourth strap 106. The sixth strap has a distal portion 130 which is mounted on the fourth strap 106 at securing point 131. The portion of the force applying system 75, including the third strap 96, the fourth strap 106, the fifth strap 116 and the sixth strap 126, substantially contained within the pocket 69 and heretofore described constitutes a member or strap assembly 140 perhaps best shown in FIG. 1. For purposes of illustrative convenience, the securing points 78, 98, 108, 118, 128 and 131 are sometimes referred to herein as "first securing points". Securing point 88 is sometimes referred to herein as the "second securing point."

OPERATION

The operation of the described embodiment of the present invention is believed to be readily apparent and is briefly summarized at this point.

Figure 2:
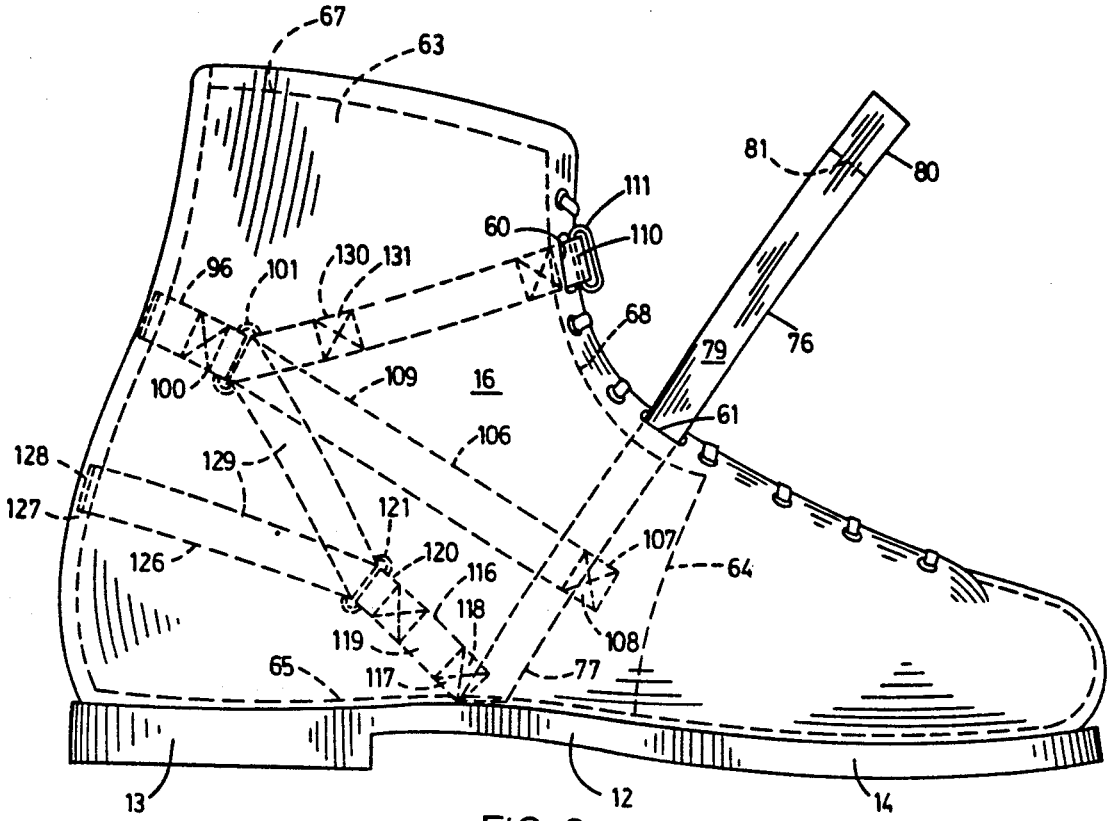
FIG. 2 is a side elevation of the boot of FIG. 1 showing a force applying strap thereof in an extended position prior to securing in an operational attitude.
Figure 3:
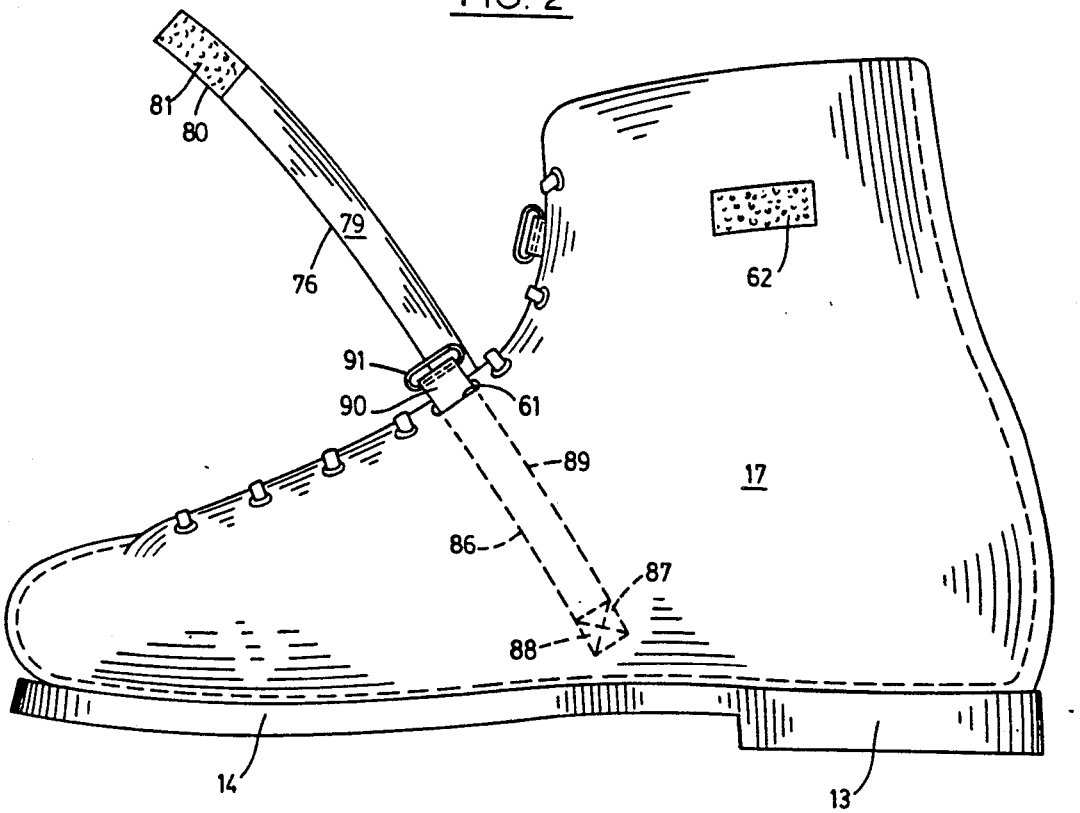
FIG. 3 is a side elevation of the boot of FIG. 1 viewed from the opposite side viewed in FIG. 2.
Figure 4:
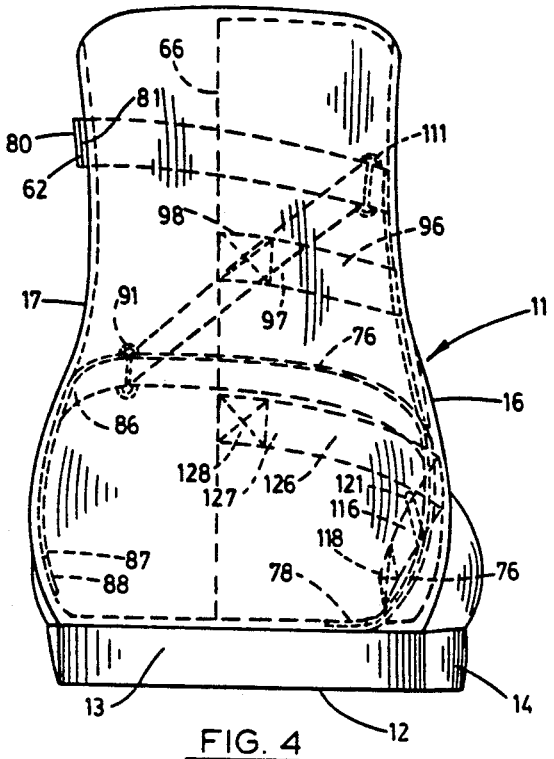
FIG. 4 is a rear elevation of the boot of FIG. 1.

The boot 11 is initially put on in the normal fashion, laced up and tied so as to be comfortable and yet secure. The boot is thus as shown in FIGS. 2 and 3 wherein the force applying system 75 is on the out side of the foot 40 separated from the foot by the interior panel 63.

In order to secure the apparatus in supporting relation to the foot 40 and ankle 41, the first strap 76 is grasped and threaded through the ring 91 of the second strap 86. The first strap is subsequently threaded through the ring 111 of the fourth strap 106 and drawn across the upper front portion 19 of the upper 15. The first strap is drawn tightly enough to provide comfortable support to the foot and ankle and the distal portion 80 is wrapped around the inner side portion 17 of the upper and secured in position by engagement of the "Velcro" patch 81 thereof with the "Velcro" patch 62.

As can best be seen in FIG. 1, threading of the first strap 76 through the ring 91 of the second strap 86 and the ring 111 of the fourth strap 106 and drawing it tight causes not only the first and second straps to be drawn together about the foot but causes the third strap 96, the fourth strap 106, the fifth strap 116, and the sixth strap 126 of the strap assembly 140 to be, in effect, drawn toward each other about the foot 40 and ankle 41 in supporting relation. In operative effect, the force applying system 75 exerts evenly distributed pressure on the outside of the foot and ankle drawing it toward the inner side portion 17 so as to grasp the foot and ankle in a manner most comfortable to the wearer and with the optimum support while cooperating with the anatomical structure and natural flexure of the muscles, tendons, ligaments and bones of the foot and ankle, as can best be visualized in FIG. 5. This is achieved without the vice like clamping effect inherent in conventional boot construction which is not only uncomfortable but causes a lack of circulation in the foot and ankle, wearing against skin and bone and which is otherwise deleterious to normal physiological functioning.

Therefore, the apparatus of the present invention is operable to support the muscles, tendons, ligaments and bones of the feet and ankles for the performance of activities such as skiing, mountain climbing, hiking and the like; interoperates with the natural anatomical flexure and functioning of these physiological structures in achieving the objective so as to minimize the pain and discomfort associated therewith; affords the optimum degree of control desired for the specific task to be performed; and is adaptable to virtually any type of shoe or boot to achieve these objectives.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. An apparatus for securing a foot, having an outer side, in footwear in supporting relation to the foot, the footwear having a sole with an upper mounted thereon, said upper having an outer side portion, an inner side portion, an upper front portion and a middle back portion, the apparatus comprising a plurality of first securing points individually mounted on the upper, at least two of which are mounted in spaced relation to each other on the outer side portion of the upper and at least two of which are mounted in spaced relation to each other on the middle back portion of the upper; a second securing point mounted on the inner side portion of said upper; a force applying assembly, including a plurality of interconnected members, the force applying assembly linking said first securing points and said second securing point, extending across said upper front portion of the upper and operable to draw the first securing points substantially toward said inner side portion of the upper; and a panel mounted on the outer side portion of the upper between said plurality of interconnected members and said outer side of the foot whereby substantially evenly distributed pressure is applied, through the panel by said operation of the force applying assembly, to said outer side of the foot in supporting relation thereto.

2. An apparatus for securing a foot in footwear having predetermined first and second sides, a sole, a middle back portion and an upper front portion, the apparatus comprising a force applying system including a plurality of first securing points mounted in substantially fixed relation on the footwear on said first side thereof arranged in a pattern extending substantially from said sole to said middle back portion of the footwear, at least one second securing point mounted in substantially fixed relation on the footwear on said second side thereof, a force applying assembly linking through said system said first securing points and said second securing point and including a first strap having a distal portion and mounted on the footwear at one of said first securing points and extending outwardly of the footwear through an opening therein substantially on the front of the footwear and a second strap mounted on the footwear at said second securing point and extending outwardly of the footwear through an opening therein substantially on the front of the footwear in juxtaposition to the first strap and a strap assembly mounted on the footwear at at least one of said first securing points and having an upper strap extending outwardly of the footwear through an opening therein substantially on said upper front portion of the footwear above said first and second straps; means borne by the footwear on said second side thereof for releasably securing said distal portion of the first strap in a selected position; and ring members are borne by the second strap and said upper strap of the strap assembly whereby the distal portion of the first strap can be drawn successively through the rings of said second strap and said upper strap of the strap assembly and drawn into secured relation with said securing means so as to apply a selected force substantially over the upper front portion of the footwear capturing the foot in the footwear.

3. An apparatus for supplying supporting force about the foot and ankle of a person wearing a boot wherein the boot has a sole, an upper having an outer side portion, an inner side portion, an upper front portion and middle back portion and an interior, the apparatus comprising:

A. a first strap having a proximal portion mounted on the boot adjacent to the sole inwardly of said outer side portion and extending outwardly of the boot through an opening in said upper front portion of said upper of the boot to a force applying portion thereof having a distal portion;

B. a second strap having a proximal portion mounted on the boot adjacent to the sole inwardly of said inner side portion and extending outwardly of the boot through an opening in said upper front portion of said upper of the boot to a distal portion mounting a ring;

C. a strap assembly mounted on the boot inwardly of the outer side portion including an upper strap having a portion extending outwardly of the boot through an opening in said upper front portion of said upper of the boot above said first and second straps to a distal portion mounting a ring; and D. fastening means mounted on the inner side portion of the boot, whereby the distal portion of said first strap can be extended through the ring of the second strap, the ring of the upper strap, drawn tight to draw the first strap, second strap and said strap assembly substantially toward each other and the distal portion of said first strap secured by said fastening means to supply supporting force to the foot and ankle of said person wearing the boot.

4. The apparatus of claim 3 wherein said strap assembly includes a third strap having a proximal portion mounted on the boot inwardly of said middle back portion of said upper and operatively linked to the upper strap so that drawing of the upper strap by the first strap draws the third strap forwardly.

5. The apparatus of claim 4 wherein the third strap has a distal portion mounting a ring, said strap assembly includes a fourth strap having a proximal portion mounted on the boot inwardly of the outer side portion of the upper and extending toward the middle back portion of the upper through the ring of the third strap and forwardly to a distal portion forming said upper strap.

6. The apparatus of claim 5 wherein said strap assembly includes a lower strap having a proximal portion mounted on the boot inwardly of said middle back portion of said upper and below the third strap and operatively linked to the upper strap so that drawing of the upper strap by the first strap draws the third and lower straps forwardly.

7. The apparatus of claim 6 wherein the third strap has a distal portion mounting a ring, said strap assembly includes a fifth strap having a proximal portion mounted on the boot inwardly of the outer side portion of the upper above the proximal portion of said first strap and extending toward the middle back portion of the upper and having a distal portion mounting a ring and said lower strap has a distal portion extending through the ring of the fifth strap and the ring of the third strap is mounted at a distal portion on the fourth strap whereby said drawing of the upper strap of the strap assembly draws the third, fourth, fifth and lower straps substantially toward each other thereby to draw the outer side portion, inner side portion, upper front portion and middle back portion of the upper substantially toward each other about the foot and ankle of a person wearing said boot.

8. The apparatus of claim 7 including a panel mounted on the boot in said interior thereof capturing said strap assembly between the panel and the outer side portion of the upper.

* * * * *